United States Patent [19]

Ursich

[11] 4,018,430

[45] Apr. 19, 1977

[54] SKI SUPPORTING DEVICE

[76] Inventor: Michael J. Ursich, 1309 Dodson Ave., San Pedro, Calif. 90732

[22] Filed: July 26, 1976

[21] Appl. No.: 708,885

[52] U.S. Cl. ..... 269/156; 248/166; 269/239; 269/321 W

[51] Int. Cl.[2] ..... B25B 5/04

[58] Field of Search ..... 269/156, 321 W, 104, 269/152, 153, 296, 243, 237, 238, 239; 248/169, 171, 166

[56] References Cited

UNITED STATES PATENTS

| | | | |
|---|---|---|---|
| 1,234,510 | 7/1917 | Trautwein | 248/171 |
| 2,772,588 | 12/1956 | Jones et al. | 269/239 |
| 3,854,712 | 12/1974 | McGee | 269/152 |
| 3,977,663 | 8/1976 | Köhler et al. | 269/153 |

FOREIGN PATENTS OR APPLICATIONS

| | | | |
|---|---|---|---|
| 278,877 | 10/1927 | United Kingdom | 248/166 |

*Primary Examiner*—Al Lawrence Smith
*Assistant Examiner*—Robert C. Watson
*Attorney, Agent, or Firm*—William C. Babcock

[57] ABSTRACT

A pair of portable supports that are adapted to removably engage longitudinally spaced sections of a ski to support the latter in an elevated substantially horizontal position above a floor surface to permit the ski to be tuned or maintenance work performed thereon. The pair of ski supports are of such structure that they are adapted to removably engage the edges of a longitudinal section of the ski irrespective of the configuration of the edges.

7 Claims, 5 Drawing Figures

SKI SUPPORTING DEVICE

BACKGROUND OF THE INVENTION

1. Field of the Invention

Ski Supporting Device.

2. Description of the Prior Art

Prior to the present invention, no light weight, portable support has been available to removably engage a ski to support the latter in a substantially horizontal position where it may be tuned or maintenance work performed thereon.

In the past, the only support for skis to have such work performed thereon were bench mounted clamps.

A major object of the present invention is to provide a pair of portable light weight supports that may be fabricated from standard commercially available materials, that have a simple structure, and may be carried from place to place by a user to removably support a ski in a substantially horizontal position where the ski may be tuned or maintenance or repair work performed thereon.

SUMMARY OF THE INVENTION

The present invention is a pair of portable light weight supports for engaging longitudinally spaced sections of a ski that have first and second laterally spaced side edge surfaces, to dispose the ski in an elevated, substantially horizontal position above a floor surface to permit the ski to be turned or maintenance work performed thereon. Each of the supports is of identical structure. Each support includes first, second and third elongate rigid spaced legs. Each of the legs has a first upwardly disposed end and a second end that rests on the floor surface. First, second and third legs extensions project upwardly and outwardly from the first ends of the first, second and third legs, and the first, second and third leg extensions including first, second and third straight, vertically disposed end portions.

First means are provided for pivotally connecting the first, second and third ends of the first, second and third legs in such a manner that the second and third end portions may be disposed in a common vertical plane, and the first end portions move normal to this vertical plane.

First, second and third clamps are pivotally supported on the first, second and third end portions. Manually operated means are provided for pivoting the first leg relative to the second and third legs to force the first clamp into pressure contact with the first side edge surface of the ski and the second and third clamp into pressure contact with the second side edge surfaces of the ski to frictionally grip a longitudinal section of the ski therebetween, with the second means when in the second position so remaining until manually moved to the first position. When the supports are so removably engaging the ski, the ski is disposed at a substantially horizontal position above the floor surface on which the first, second and third legs rest, and the ski may be tuned or have maintenance work performed thereon. After the turning or maintenance work has been performed thereon, the first leg is pivoted to the first position where it is released from the support, and the support may be then folded into a compact configuration until again needed.

DESCRIPTION OF THE PREFERRED EMBODIMENT

Figure 1:
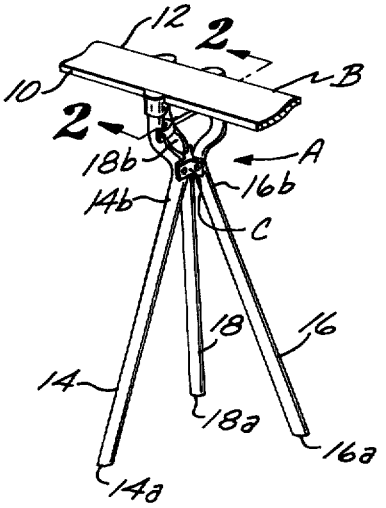
FIG. 1 is a perspective view of one of the ski supports removably engaging a desired longitudinal section of a ski to hold the ski in a horizontal position where it may be tuned or maintenance work performed thereon.

The invention is a pair of tri-pod like ski supports A, one of which is shown in FIG. 1 that may removably engage a desired longitudinal section of a ski B, to maintain the latter in a substantially horizontal position where the ski may be tuned or have maintenance work performed thereon. The ski B has first and second longitudinal side edge surfaces 10 and 12, which side edge surfaces may be either parallel, angularly disposed relative to one another, or have portions thereof angling outwardly relative to the longitudinal axis of the ski.

Each of the inventions A includes first, second and third legs 14, 16 and 18, that are preferably formed from light weight tubular stocks, such as aluminium tubing or the like. The first, second and third legs 14, 16 and 18 include first ends **14*a*, 16*a* and 18*a* and second ends 14*b*, 16*b*, and 18*b* as may be seen in FIG. 1. First, second and third tubular extensions 14*c*, 16*c* and 18*c* project upwardly from the first ends 14*a*, 16*a* and 18*a* of the legs, and these extensions including first, second and third end portions 14*d*, 16*d* and 18*d*** that are straight and vertically disposed relative to the ground surface when the invention A is disposed as shown in FIG. 1.

Each of the inventions A includes first means C for pivotally connecting the first, second and third legs 10, 12 and 14 together as shown in FIG. 1.

Figure 5:
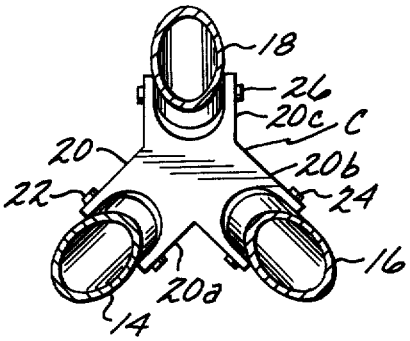
FIG. 5 is a fragmentary combined top plan view and transverse cross sectional view taken on the line 5—5 of FIG. 3.

The first means C includes a rigid body that has first, second and third circumferentially spaced arms **20*a*, 20*b* and 20*c* defined thereon. The first, second and third arms 20*a*, 20*b* and 20*c* have bifurcated free ends that serve to support first, second and third pins 22, 24 and 26 therein, and these pins passing through transverse bores formed in the first end 14*a*, 16*a* and 18*a* of the first, second and third legs 14, 16 and 18** as shown in FIG. 5.

Figure 2:
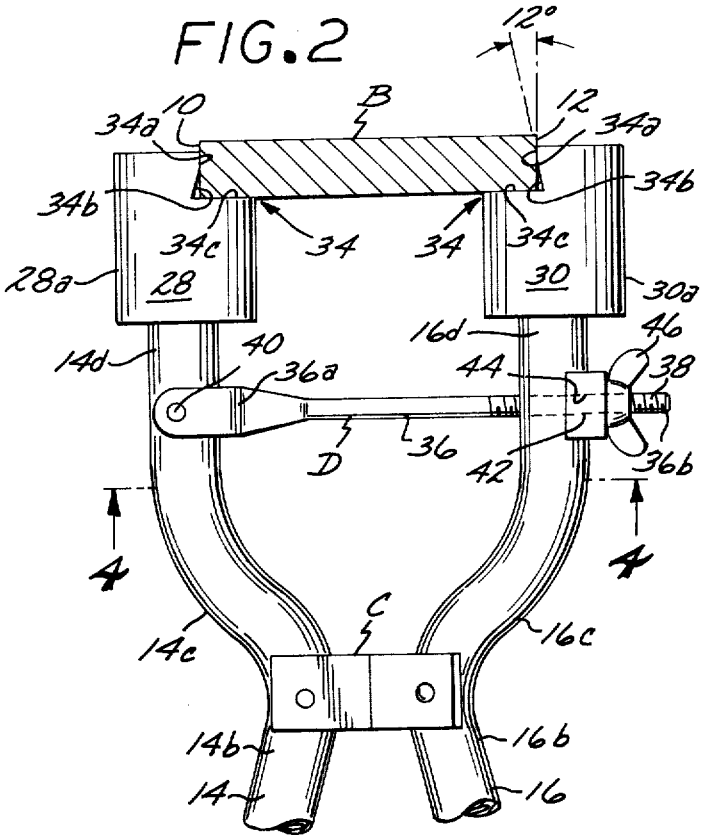
FIG. 2 is a fragmentary vertical cross sectional and end elevational view of the invention taken on the line 2—2 of FIG. 1.
Figure 3:
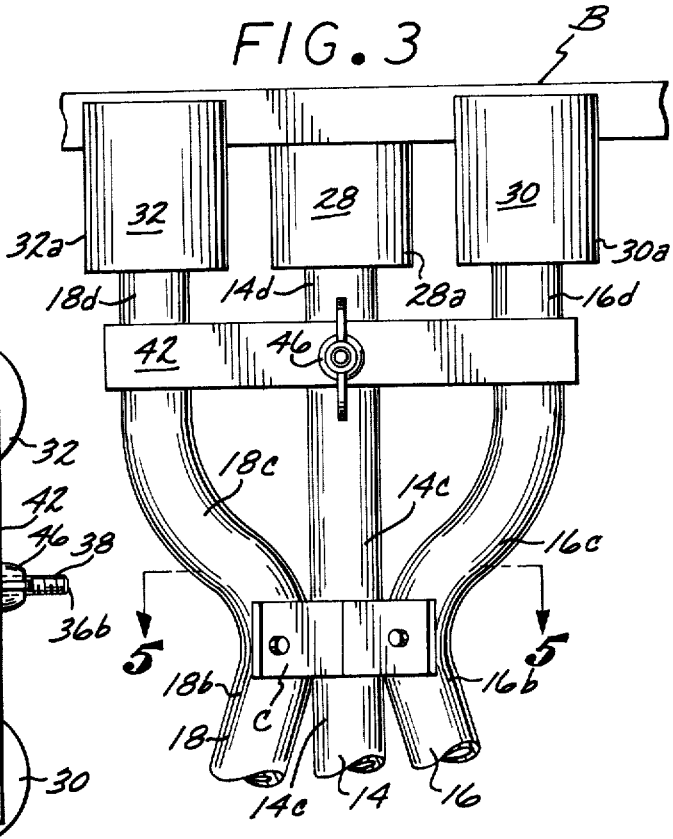
FIG. 3 is a side elevational view of the upper portion of one of the pair of supports, and illustrating the support in removable engagement with the ski.

First, second and third clamps 28, 30 and 32 are provided that are in the form of rollers that are rotatably supported on the upper extremities of the first, second and third end portions **14*d*, 16*d* and 18*d* as may be seen in FIG. 3, with the rollers having first, second and third cylindrical surfaces 28*a*, 30*a* and 32*a*. Each of the first, second and third clamps 28, 30 and 32 includes an upwardly disposed longitudinally extending recess 34 that is defined by a flat upper surface 34*a*, an angle surface 34*b* situated therebelow, and a horizontal surface 34*c*, as may be seen in FIG. 2. The angled surfaces 34*b* as may best be seen in FIG. 2 project downwardly and outwardly at an angle substantially 12° with the vertical, and permit a ski having an angularly disposed portion to be situated adjacent thereto and grip by the clamps. The flat surfaces 34***a* frictionally grip adjacent portions of the first and second longitudinal side surfaces 10 and 12 as shown in FIG. 2. The first, second and third extensions 14*c*, 16*c* and 18*c* are of such configuration that the second and third clamps 30 and 32 lie in a common vertical plane, and with the first clamp 28 capable of being moved either towards or away from the plane in which the second and third clamps 30 and 32 lie.

Figure 4:
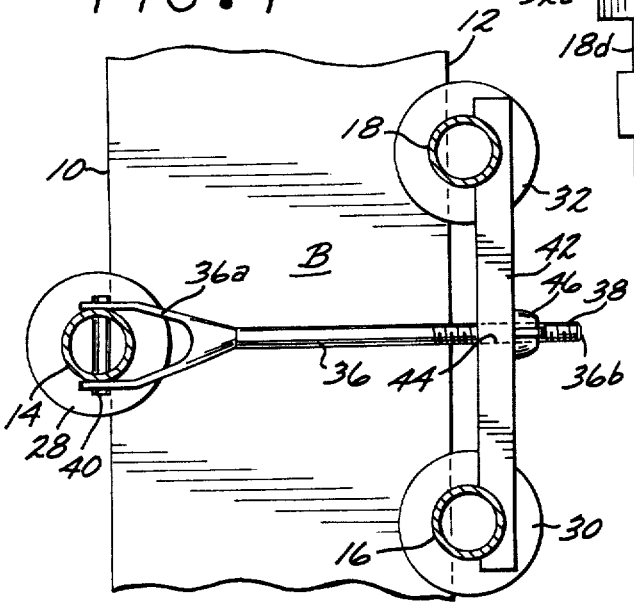
FIG. 4 is a transverse cross sectional view of the invention taken on the line 4—4 of FIG. 2.

Manually operated means D are provided for pivoting the first leg 14 relative to the second and third legs 16 and 18 to removably grip a ski D as shown in FIG. 1. The manually operated means D includes an elongate rod 36 that has a bifurcated first end portion 36*a* and a second end portion 36*b* best seen in FIG. 4. External threads 38 are formed on the second end portion 36*b*. A pin 40 extends through transversely aligned openings formed in the first end portion 14*d* and in the bifurcated end 36*a*. A bar 42 is provided that has a transverse bore 44 therein through which the second end portion 36*b* of the rod 36 extends. The bar, as may be seen in FIG. 4 is in abutting contact with the second and third end portions 16*d* and 18*d* of the second and third legs 16 and 18. The threads 38 are engaged by a wing nut 46, which nut when tightened bears against the bar 42, and as the wing nut is rotated in a first direction, causes the end portion 14*d* to move towards the second and third end portions 16*d* and 18*d*.

The use and operation of the invention is extremely simple. The two supports A are spaced from one another a desired distance, and the ski B then disposed in a position to rest thereon, with each of the two spaced sections of the ski being disposed between a first clamp 28 and second and third clamp 30 and 32 as shown in FIG. 1. The wing nut 46 is now rotated in a first direction to force the first clamp 28 and second and third clamp 30 and 32 into gripping contact with the ski as shown in FIG. 2. The ski is now supported in a horizontal position, and may be tuned to have maintenance work performed thereon. After the tuning is then completed, the wing nut 46 are rotated in a second direction, to permit the first clamp 28 to be pivoted away from the second and third clamp 30 and 32, and permit the ski B to be separated from the supports A. The supports A may be then folded into a compact configuration and stored in a suitable place until again needed.

The use and operation of the invention has been described previously in detail and need not be repeated.

I claim:

1. A pair of portable supports for removably engaging longitudinally spaced sections of a ski that has first and second laterally spaced side surfaces to dispose the latter in an elevated substantially horizontal position above a floor surface to permit the ski to be tuned or maintenance work performed thereon, each of said supports including:

a. first, second and third elongate rigid spaced legs that each have first upwardly disposed ends and second ends that rest on a floor surface, first, second and third leg extensions that project upwardly and outwardly from said first ends of said first, second and third legs, and said first, second and third leg extensions including first, second and third straight vertically disposable end portions;

b. first means for pivotally connecting said first, second and third ends of said first, second and third legs in such a manner that said second and third end portions may be disposed in a common vertical plane and said first end portion moved normal to said vertical plane;

c. first, second and third clamps pivotally supported on said first, second and third end portions; and d. second, manually operated means for pivoting said first leg from a first to a second position relative to said second and third legs to force said first clamp into pressure contact with said first side edge surface and said second and third clamps into pressure contact with said second side edge surfaces to frictionally grip a longitudinal section of said ski therebetween, with said second means when in said second position so remaining until manually moved to said first position.

2. A support as defined in claim 1 in which said first means is a rigid body that defines first, second and third circumferentially spaced outwardly extending arms that have said first ends of said first second and third legs pivotally connected thereto.

3. A support as defined in claim 1 in which said second means includes:

e. a rod that has first and second end portions, said second end portion having external threads defined thereon;

f. third means that pivotally connect said first end portion to said first extension of said first leg;

g. a bar that has a transverse bore therein through which said second end portion of said rod extends said rod in abutting contact with said second and third extensions of said second and third legs; and h. a nut that engages said external threads of said second end portion, said nut when tightened being forced into pressure contact with said bar for said bar and rod to cooperate to force said first, second and third clamps into gripping contact with said ski.

4. A support as defined in claim 1 in which said first, second and third clamps are first, second and third rollers pivotally supported on said first, second and third end portions.

5. A support as defined in claim 4 in which said first, second and third rollers have first, second and third longitudinal recesses defined therein in which said longitudinal section of said ski rests, and said rollers as said first leg is pivoted from said first to a second position pivoting to dispose at least a portion of said first, second and third recesses into pressure contact with said first and second side surfaces of said ski.

6. A support as defined in claim 5 in which said portions of said first, second and third recesses are flat and may be brought into said pressure contact with said first and second side surfaces of said ski irrespective of whether said first and second side surfaces are parallel or angularly disposed relative to one another.

7. A support as defined in claim 6 in which said first, second and third recesses are of such configuration as to accommodate a ski having a longitudinal section in which said first and second side surfaces are defined by both flat longitudinally extending portions and transversely angled portions.

* * * * *